United States Patent [19]

Anderson et al.

[11] Patent Number: 4,513,454

[45] Date of Patent: Apr. 30, 1985

[54] ZODIAC DESIGNER JEANS

[75] Inventors: Alan Anderson, 58 Canaan Circle, Greensboro, Ga. 30642; George Spector, New York, N.Y.

[73] Assignee: Alan Anderson, Greensboro, Ga.

[21] Appl. No.: 544,843

[22] Filed: Oct. 24, 1983

[51] Int. Cl.[3] ..... A41D 27/20

[52] U.S. Cl. ..... 2/246; 2/DIG. 6

[58] Field of Search ..... 2/247, 248, 249, 246, 2/DIG. 6, 250, 251, 327

[56] References Cited

U.S. PATENT DOCUMENTS 2,530,453 11/1950 Eagle ..... 2/247
2,671,902 3/1954 Grue ..... 2/247
3,438,062 4/1969 Dobell ..... 2/247
4,446,573 5/1984 Green ..... 2/247

FOREIGN PATENT DOCUMENTS 1497611 9/1967 France ..... 2/DIG. 6

*Primary Examiner*—Doris L. Troutman

[57] ABSTRACT

Garments, particularly designer type jeans, are provided with interchangeable outer patches, particularly in the position of the seat pocket. The garment and the portion of fabric constituting the outer patch have interengaging devices, for example, adhesive, a press-stud and a loop-hook fabric fastener for releasably securing the two together.

2 Claims, 6 Drawing Figures

ZODIAC DESIGNER JEANS

BACKGROUND OF THE INVENTION

The instant invention relates generally to garments and more specifically it relates to a designer type jeans having a zodiac symbol placed on a seat socket.

Numerous garments have been provided in prior art that are adapted to contain pockets. For example, U.S. Pat. Nos. 2,986,743; 3,438,062 and 3,447,165 all are illustrative of such prior art. While these units may be suitable for the particular purpose to which they address, they would not be suitable for the purposes of the present invention as heretofore described.

SUMMARY OF THE INVENTION

A principle object of the present invention is to provide a garment that is a designer type jeans having zodiac symbols interchangeably placed onto the seat pockets.

Another object is to provide a garment that is a designer type jeans having zodiac symbols and simulated pocket flaps interchangeably placed onto the seat pockets.

An additional object is to provide a garment that is a designer type jeans having outer patches on the seat pockets and utilizing interengaging devices for releasably securing the outer patches onto the seat pockets.

A further object is to provide a garment that is a designer type jeans having outer patches that are simple and easy to use.

A still further object is to provide a garment that is a designer type jeans having outer patches that is economical in cost to manufacture.

Further objects of the invention will appear as the description proceeds.

To the accomplishment of the above and related objects, this invention may be embodied in the form illustrated in the accompanying drawings, attention being called to the fact, however, that the drawings are illustrative only, and that changes may be made in the specific construction illustrated and described within the scope of the appended claims.

BRIEF DESCRIPTION OF THE DRAWING FIGURES

DETAILED DESCRIPTION OF THE PREFERRED EMBODIMENTS

Figure 1:
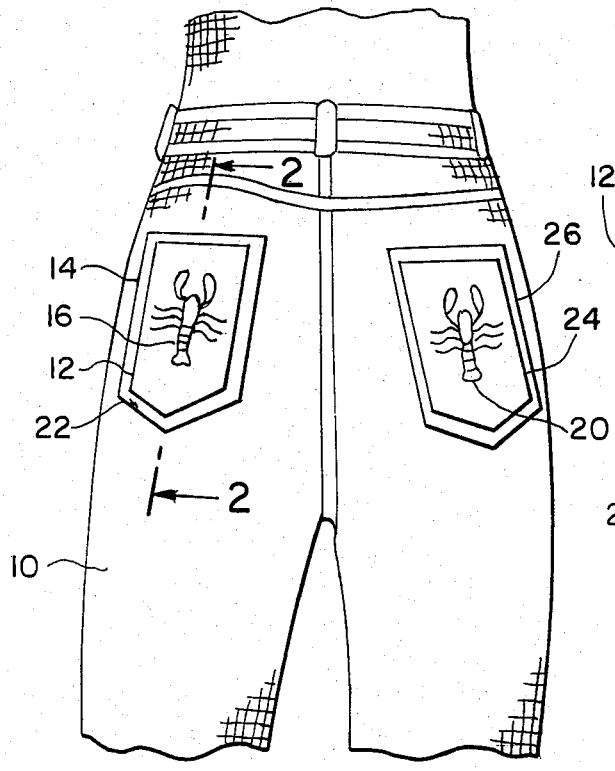
FIG. 1 is a rear elevational view of a pair of designer type jeans showing the invention in place.
Figure 2:
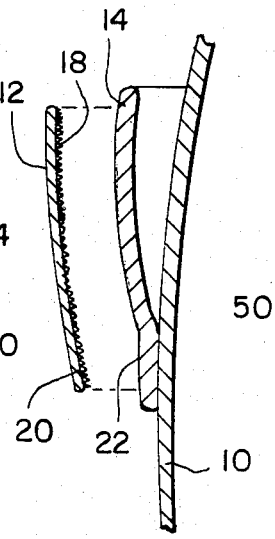
FIG. 2 is a partial exploded cross sectional view taken along line 2—2 in FIG. 1.

Turning now descriptively to the drawings, in which similar reference characters denote similar elements throughout the several views, FIGS. 1 and 2 illustrates a garment 10 such as a designer type jeans. A piece of fabric 12 is formed as an outer patch for seat pocket 14 and is slightly smaller in shape than the pocket 14. The fabric 12 has a zodiac symbol 16 sewn, printed or painted thereon but other zodiac symbols and designs can be used in place of the zodiac symbol 16 shown in FIG. 1.

Adhesive 18 is affixed to rear surface 20 of the piece of fabric 12 for removably attaching the piece of fabric 12 to outer surface 22 of the pocket 14. Another piece of fabric 24 also has adhesive 18 and is attached to the pocket 26 in the same manner as the piece of fabric 12.

Figure 3:
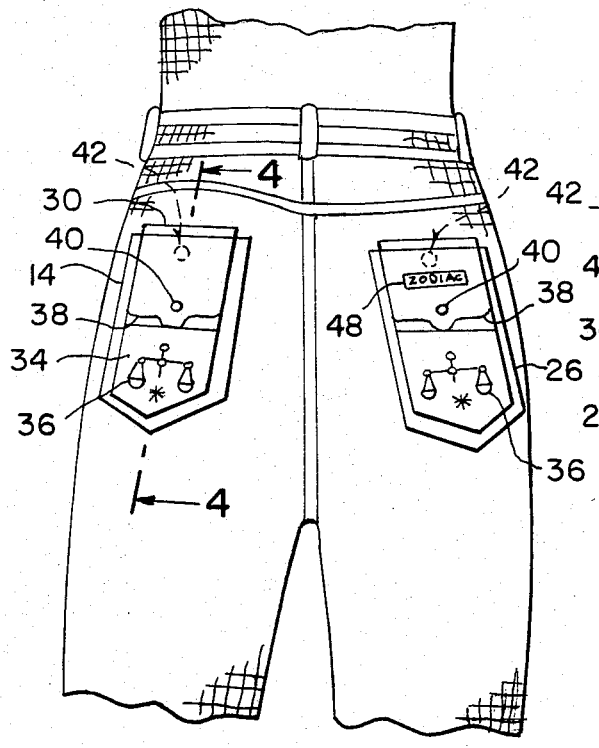
FIG. 3 is a rear elevational view of a pair of designer type jeans showing a modification.
Figure 4:
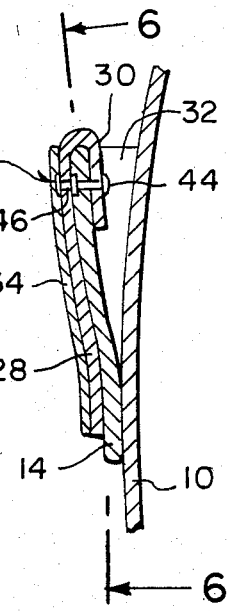
FIG. 4 is a cross sectional view taken along line 4—4 in FIG. 3.

In FIGS. 3 and 4 a first piece of fabric 28 is formed for the seat pocket 14 of the garment 10, is slightly smaller in shape than the pocket 14 and has a top flap member 30 that is tucked into top 32 of the pocket 14. A second piece of fabric 34 is formed as an outer patch for the pocket 14 of the garment 10, slightly smaller in shape than the pocket and attached to the first piece of fabric 28 such as by sewing, adhesive, etc. The second piece of fabric 34 has a zodiac symbol 36 and a simulated pocket flap 38 with snap design 40 sewn, printed or painted thereon.

A press-stud or snap fastener 42 is provided for removably attaching the first piece of fabric 28 to the pocket 14. The press-stud 42 has a male portion 44 attached to the top flap member 30 and a female portion 46 attached to the first piece of fabric 28. When the top flap member 30 is tucked into the top 32 of the pocket 14 the male portion 44 will be in alignment with the female portion 46, travel through top 32 of the pocket and into the female portion 46. The other pocket 26 has the identical configuration attached to it except the word zodiac in a box 48 is placed thereon.

Figure 5:
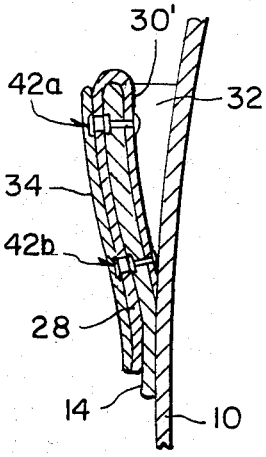
FIG. 5 is a cross sectional view of another modification.

In FIG. 5 an elongated top flap member 30' is provided on the first piece of fabric 28 so that two press-studs **42*a* and 42*b* can be used for removably attaching the first piece of fabric 28 to the pocket 14**.

Figure 6:
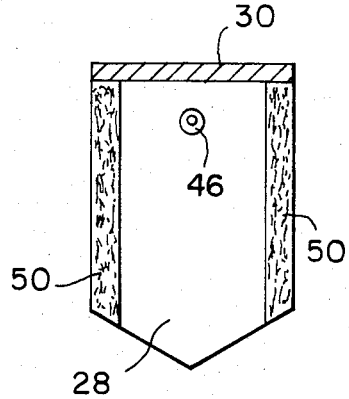
FIG. 6 is a cross sectional view taken along line 6—6 in FIG. 4 showing still another modification.

In FIG. 6 two strips of loop-hook fabric fasteners 50 are secured between the first piece of fabric 28 and the pocket 14 (now shown) so as to hold them firmly together to prevent accidental separation while still permitting deliberate separation by reason of flexibility of the loop-hook fabric fastener 50.

While certain novel features of this invention have been shown and described and are pointed out in the annexed claims, it will be understood that various omissions, substitutions and changes in the forms and details of the device illustrated and in its operation can be made by those skilled in the art without departing from the spirit of the invention.

What is claimed is:

1. A garment comprising:

a. a first piece of fabric formed for a pocket of the garment, slightly smaller in shape than the pocket having a symbol receiving area engaging the outer side of the pocket, a top flap member that is tucked inside the top of the pocket;

b. a second piece of fabric formed as an outer patch for the pocket of the garment, slightly smaller in shape than the pocket and attached to said symbol receiving area; and c. means for removeably attaching said first piece of fabric to the pocket wherein said second piece of fabric having a zodiac symbol and a simulated pocket flap with snap wherein said means for removably attaching said first piece of fabric to the pocket is at least one press-stud having a male portion attached to the top flap member and a female portion attached to said symbol receiving area so that when the top flap member is tucked into top of the pocket said male portion will be in alignment with said female portion and will pass through top of the pocket and into the female portion thereby causing said symbol receiving area and said flap member to lay in close engagement with said pocket.

2. A garment as in claim 1 wherein said tucked in portion is extended to the base of the pocket so that a second press-stud is mounted on said first piece of fabric and pocket below the first said press-stud to effect a better engagement with said pocket.

* * * * *